US006663431B1

(12) United States Patent
Brehm et al.

(10) Patent No.: US 6,663,431 B1
(45) Date of Patent: Dec. 16, 2003

(54) SHIELDING IN A POWER CONNECTOR

(75) Inventors: George W. Brehm, Holmes, NY (US); Robert K. Mullady, Highland, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/232,305

(22) Filed: Aug. 30, 2002

(51) Int. Cl.[7] ..... H01R 13/648
(52) U.S. Cl. ..... 439/609; 439/96; 439/89
(58) Field of Search ..... 439/609, 95, 96, 439/98, 99, 89, 108, 610, 607; 174/35 GC

(56) References Cited

U.S. PATENT DOCUMENTS

| | | | | |
|---|---|---|---|---|
| 4,296,390 A | | 10/1981 | Vanderheyden et al. | 333/182 |
| 4,889,497 A | | 12/1989 | Riches | 439/76 |
| 5,035,651 A | | 7/1991 | Dixon et al. | 439/609 |
| 5,112,251 A | | 5/1992 | Cesar | 439/607 |
| 5,178,562 A | | 1/1993 | Ermini | 439/609 |
| 5,204,496 A | | 4/1993 | Boulay et al. | 174/35 |
| 5,246,387 A | | 9/1993 | Liebich et al. | 439/620 |
| 5,288,248 A | | 2/1994 | Chen | 439/609 |
| 5,317,105 A | | 5/1994 | Weber | 174/35 |
| 5,647,765 A | | 7/1997 | Haas et al. | 439/609 |
| 5,735,712 A | | 4/1998 | Haas et al. | 439/609 |
| 5,847,317 A | * | 12/1998 | Phelps | 174/35 R |
| 6,010,365 A | | 1/2000 | Wu et al. | 439/607 |
| 6,078,504 A | * | 6/2000 | Miles | 361/727 |
| 6,080,018 A | * | 6/2000 | Ferrill et al. | 439/610 |
| 6,093,058 A | | 7/2000 | Wu | 439/607 |
| 6,149,444 A | | 11/2000 | Shi et al. | 329/95 |
| 6,234,841 B1 | | 5/2001 | Chang et al. | 439/609 |
| 6,238,246 B1 | * | 5/2001 | Ferrill et al. | 439/610 |
| 6,282,101 B1 | * | 8/2001 | Hanas et al. | 361/818 |
| 6,309,742 B1 | * | 10/2001 | Clupper et al. | 428/304.4 |
| 6,320,122 B1 | * | 11/2001 | Dickey et al. | 174/35 GC |
| 6,331,349 B1 | * | 12/2001 | Kalinoski et al. | 428/220 |
| 6,339,536 B1 | * | 1/2002 | Buican et al. | 361/818 |
| 6,359,214 B1 | * | 3/2002 | Worley et al. | 174/35 GC |
| 6,387,523 B2 | * | 5/2002 | Bunyan et al. | 428/457 |
| 6,395,402 B1 | * | 5/2002 | Lambert et al. | 428/550 |
| 6,410,846 B1 | * | 6/2002 | Benn, Jr. | 174/35 GC |
| 6,465,731 B1 | * | 10/2002 | Miska | 174/35 GC |
| 6,477,061 B1 | * | 11/2002 | Johnson | 361/818 |

* cited by examiner

*Primary Examiner*—Ross Gushi
(74) *Attorney, Agent, or Firm*—Floyd A. Gonzalez

(57) ABSTRACT

An electrical connector and method for making power connections between multiple power conductors in a shielded power cord and electrical components in a metal cabinet having a panel with a receptacle therein for receiving the electrical connector. A connector core has power contacts connected to power conductors in the power cord for electrical connection with contacts in the receptacle in the metal cabinet when the connector is seated in the receptacle. A conductive foam member is provided around the front edge of said connector core for contact with the face of the panel member when the electrical connector is seated in the receptacle. A metal shield around the connector core and over said conductive foam member makes electrical contact between the conductive foam member and the metal shield for forming an electrical shield around said connector core. The metal shield is in electrical contact with the shield of the power cable. The conductive foam member is conductive fabric over a core of open-celled polyether polyurethane foam in a high resiliency formula.

18 Claims, 2 Drawing Sheets

SHIELDING IN A POWER CONNECTOR

BACKGROUND OF THE INVENTION

The present invention is related to providing shielding in an electrical connector, and is more particularly related to providing shielding in a power connector to provide for Electromagnetic Compatibility (EMC).

U.S. Pat. No. 5,647,765 issued Jul. 15, 1997 to Haas et al. For SHIELDED CONNECTOR WITH CONDUCTIVE GASKET INTERFACE and U.S. Pat. No. 5,735,712 issued Apr. 7, 1998 to Haas et al. for SHIELDED CONNECTOR CONDUCTIVE GASKET INTERFACE disclose a connector with a stamped metallic shield. About the edge of the face of the connector is an electrically conductive compliant member, the conductive member secured to the shield by a plurality of metallic hooks. When the assembly is mounted in place on a metal panel, the conductive compliant member makes electrical contact with the panel, and simultaneously makes electrical contact with the shield.

U.S. Pat. No. 5,112,251 issued May 12, 1992 to Cesar for ELECTRICAL CONNECTOR FOR CONNECTING A SHIELDED MULTICONDUCTOR CABLE TO AN ELECTRICAL ASSEMBLY LOCATED INSIDE A CHASSIS discloses a connector with electrically conductive sheets disposed in the inner space between the two insulating covers. The conductive sheets have a flexible part with an end portion for cooperating with the housing panel.

U.S. Pat. No. 5,035,651 issued Jul. 30, 1991 to Dixon et al. for MINIATURE CIRCULAR DIN CONNECTOR discloses a housing constructed to receive a conductive internal shield. An embodiment is disclosed having an internal shield with shield extensions. The extensions abut and electrically contact a conducting grounding chassis panel.

U.S. Pat. No. 4,889,497 issued Dec. 26, 1989 to Riches for SHIELDED ELECTRICAL CONNECTOR discloses a shielded connector assembly with an elastomeric conductive seal on the leading edge of a housing. The seal makes up any unevenness of fit between the housing and the cooperating connector in a second housing or in a metal panel.

U.S. Pat. No. 4,296,390 issued Oct. 21, 1981 to Vanderhayden et al. for SOLDERLESS FILTER MOUNTING FOR HEADER ASSEMBLIES discloses a conductive rubber gasket to assure electrical contact between filter pins and a ground plane.

U.S. Pat. Nos. 5,204,496; 5,246,387; 5,288,248; 5,317,105; 6,010,365; 6,093,058; 6,149,444; and 6,234,841 disclose examples of front-mounted metal members used to electrically connect a connector housing to a panel.

SUMMARY OF THE INVENTION

The present invention provides a method of grounding an internal shield of a plastic power connector to provide an EMC effective perimeter ground path. This is done by attaching a conductive foam gasket material to the exterior, front surface of the backshell of the connector that will be in electrical contact with the inner shield. The conductive foam gasket allows electrical contact between the mounting panel and the inner shield for varying distances between the backshell and the mounting panel and it will also accommodate irregular geometries in the panel face.

BRIEF DESCRIPTION OF THE DRAWINGS

These and other objects will be apparent to one skilled in the art from the following detailed description of the invention taken in conjunction with the accompanying drawings in which.

Figure 1:
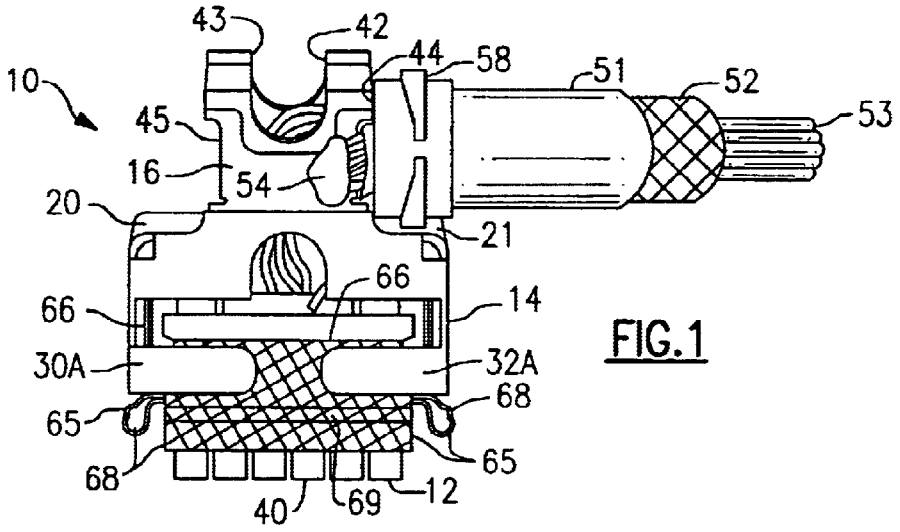
FIG. 1 is a top view of a plastic power connector with the cover removed, the connector having shielding of the present invention.
Figure 2:
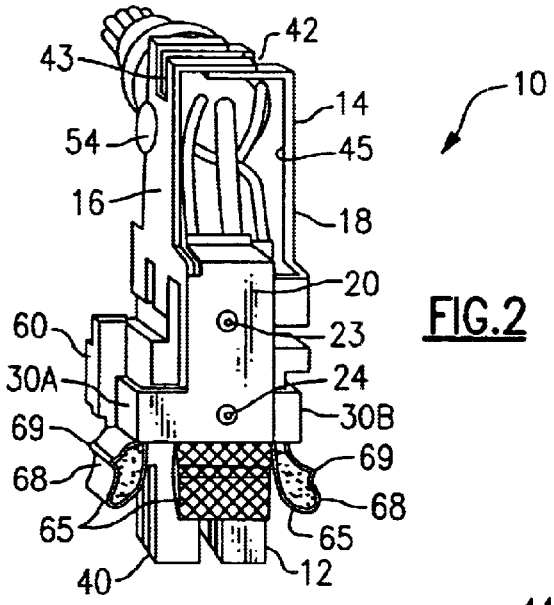
FIG. 2 is a right hand edge view of the power connector of FIG. 1.

DESCRIPTION OF THE PREFERRED EMBODIMENT:

FIG. 1 is a top view of a connector 10 of the present invention and includes a plastic power connector core (referred further herein as the plastic connector 12) surrounded by a metal backshell 14. The backshell 14 is made up of a top half 16, a bottom half 18 which are fitted together around the plastic connector 12 and held together by a pair of clips 20 and 21. The clips 20 and 21 are electrically connected by one or the other of the halfs 16 or 18 by dimples 23 and 24 (see FIG. 2). The clip 20 has tabs 30A and 30B, and the clip 21 has tabs 32A and 32B which are bent around the halts 16 and 18 to hold them together to form the backshell 14. It will be understood that the halfs 16 and 18, and the clips 20 and 21, respectively, are identical to simplify construction of the backshell 14.

The finger end 35 of the plastic connector 12 extends out of the front end 40 of the backshell 14 to be mated with connector receptacle in, for instance, a cabinet to supply electrical power to components within the cabinet. It will be understood that the finger end 35 of the plastic connector 12 includes electrical contacts which are connected to electrical conductors 53 in the power cord 50. The contacts in the plastic connector 12 will come into electrical contact with contacts in the receptacle 75 of FIG. 4 when the connector 10 is seated into the receptacle 75, as well understood by those of ordinary skill in the art. The back 42 of the backshell 14 has an opening 43 for an electrical power cable in an inline design (for instance, shown in FIG. 4), or openings 44 and 45 for either a right right-angle connection (shown in FIGS. 1–3) or a left right-angle connection of the power cord.

The power cord 50 includes an elastomeric covering 51, a shield layer 52 made, for instance, of a metal braid, and a plurality of cables 53 for supplying electrical power to the connector 12. The braid is welded or soldered to the top and bottom halfs 16 and 18 at 55 and 56, respectively, to make an electrical connection from the shield layer 52 of the power cord 50 to the backshell 14. The power cable 50 is connected to the backshell 14 by a strain relief member 58.

The plastic connector 12 includes a latch mechanism 60 connected on one side, for example the bottom side, to latch the connector into place when the power connection is made. The latch 60 does not form part of the present invention so the details of the latch are not shown or explained further.

An Electromagnetic Interference (EMI) gasket 65 is placed around the plastic connector 12 for making electrical connection between the backshell 14 and, for instance, a cabinet when the connector 10 is plugged into a receptacle. The gasket 65 has a reduced portion 66 which is placed between the backshell 14 members and the plastic connector 12, and an enlarged portion 68 which extends past beyond the backshell 14 and covers the plastic connector 12. The enlarged portion 68 has a lip 69 on the outside face which stiffens the enlarged portion 68.

Figure 3:
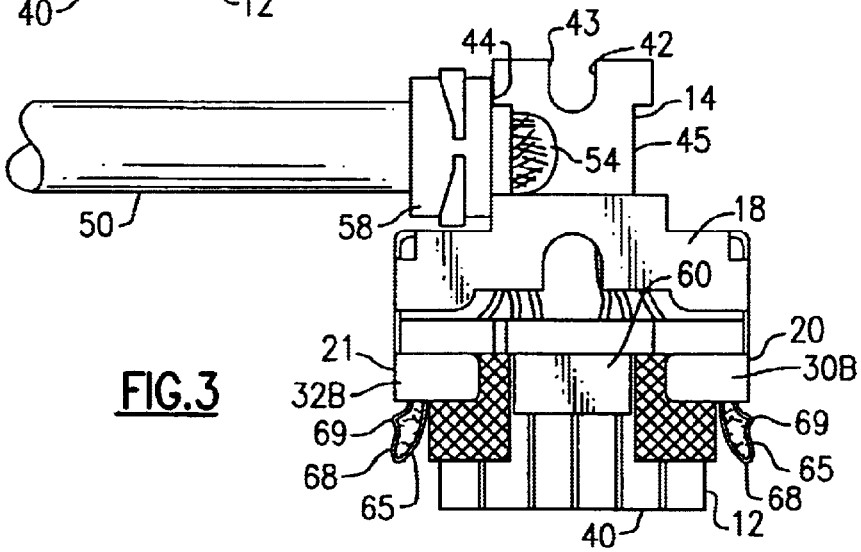
FIG. 3 is a bottom view of the connector of FIG. 1.

The gasket 65 is, preferably, a conductive fabric clad open-celled polyether polyurethane foam in a high resiliency formula having minimal compression set characteristics. One preferred EMI shielding gasket material is available from Schlegel, Inc. 1555 Jefferson Road, Rochester, N.Y. 14623. The reduced portion 66 is adhesively secured to the plastic connector 12 before the backshell 14 is assembled over the plastic connector 12. It will be understood that the adhesive is not required to be conductive since electrical connection between the backshell 14 and the gasket is made when the halves 16 and 18 are placed over the connector 12 and the tabs 30A, 30B, 32A, and 32B are folded over the reduced portions 66. If desired, the gasket 65 may be cut into pieces to fit on each side of the latch 60, as shown in FIG. 3.

Figure 4:
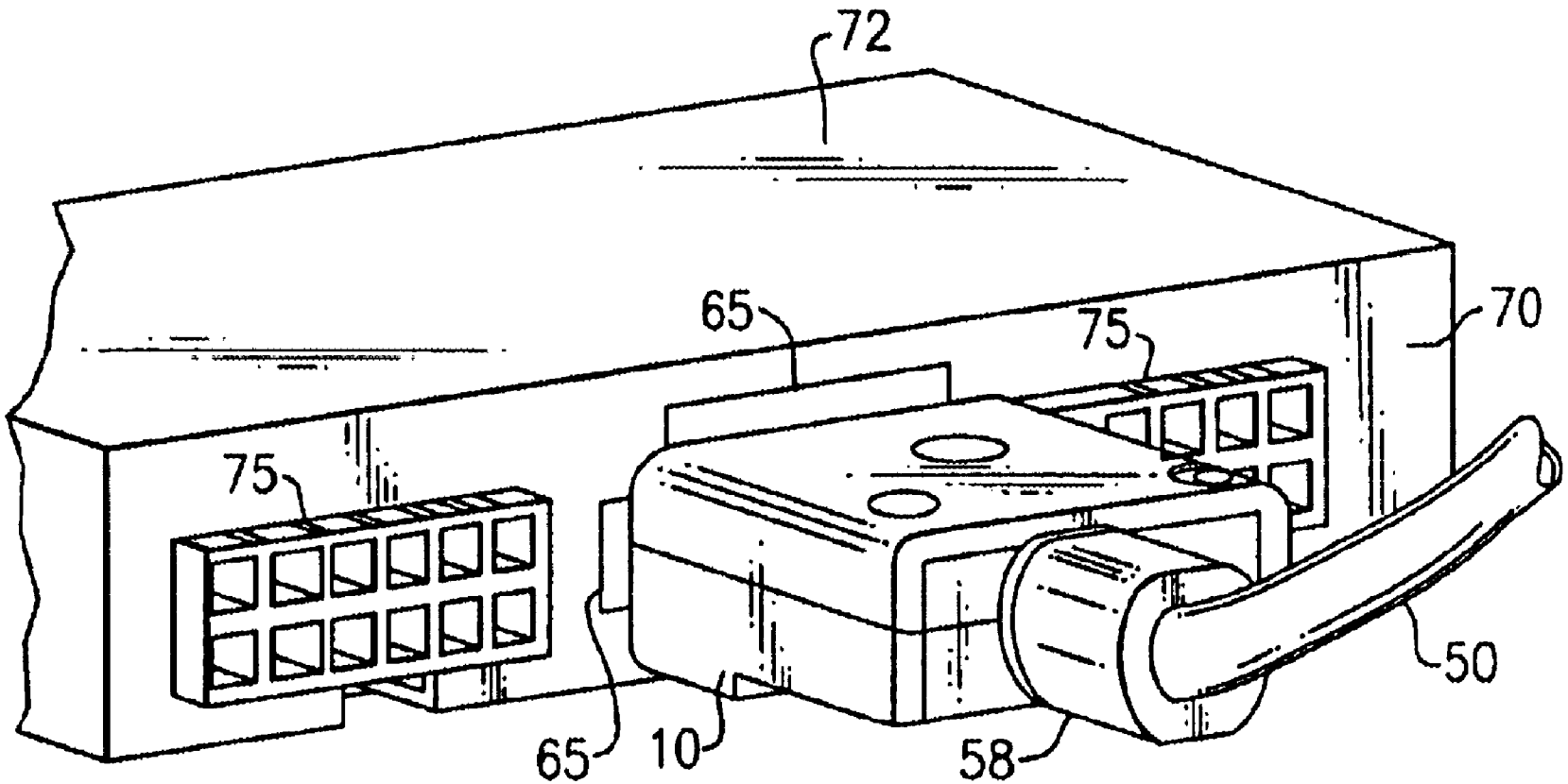
FIG. 4 is a view of another configuration of the connector of FIG. 1 plugged into the front panel of a cabinet wherein the shield of the present invention is electrically connected to the front panel to provide EMC grounding.

FIG. 4 is a diagram of another preferred power connector 10 connected to a receptacle in a panel 70 of a cabinet 72. The receptacle may be the same as the receptacles 75 designed to mate with the plastic connector 12. The connector 10 of FIG. 4 is an inline connector with the power cord 50 connected in the opening 43 of the backshell 14, as previously discussed. When the connector 10 is seated in the receptacle 75, the gasket 65 is pushed tightly into electrical contact with the panel 70. The lip 69 stiffens the gasket 65 to keep the gasket 65 in tight engagement with the panel face, to make good electrical contact between the gasket 65 and the panel 70, to accommodate varying distances between the backshell 14 and the mounting panel 70, and to accommodate irregular geometries in the panel face.

While the preferred embodiment of the invention has been illustrated and described herein, it is to be understood that the invention is not limited to the precise construction herein disclosed, and the right is reserved to all changes and modifications coming within the scope of the invention as defined in the appended claims.

What is claimed is:

1. An electrical connector for making power connections between multiple power conductors in a shielded power cord and electrical components in a metal cabinet having a panel with a receptacle therein for receiving the electrical connector, the electrical connector comprising:

a connector core having power contacts connected to power conductors in the power cord said contacts for electrical connection with contacts in the receptacle in the metal cabinet when the connector is seated in the receptacle;

a conductive foam member around the front edge of said connector core for contact with the face of the panel member when the electrical connector is seated in the receptacle; and a metal shield around the connector core and over said conductive foam member for making electrical contact between the conductive foam member and the metal shield for forming an electrical shield around said connector core, said metal shield further being in electrical contact with the shield of said power cable.

2. The electrical connector of claim 1 wherein said connector core is plastic having finger members for containing contacts in electrical connection with conductors in said power cord.

3. The electrical connector of claim 1 wherein said conductive foam member is adhesively attached to said connector core before said metal shield is placed around said connector core.

4. The electrical connector of claim 1 wherein the power cord shield is welded to said metal shield for making electrical connection with the power cord shield and said metal shield.

5. The electrical connector of claim 1 wherein said metal shield comprises top and bottom members which fit over said conductive foam member around said connector core, and a pair of clamp members which clamp said top and bottom members together.

6. The electrical connector of claim 5 wherein said clamp members have metal tabs which fold over at least a portion of said conductive foam member making electrical contact between said metal shield and said conductive foam member.

7. The electrical connector of claim 1 wherein said conductive foam member comprise electrical conducting fabric over a core of open-celled polyether polyurethane foam.

8. The electrical connector of claim 7 wherein said conductive foam member has a reduced portion between said connector core and said metal members, and an enlarged portion extending past the connector core for resilient connection with the panel face when the electrical connector is seated in the receptacle.

9. The electrical connector of claim 8 wherein said conductive foam member has a lip on the outside of said enlarged portion for stiffening said enlarged portion.

10. A method of making power connections between multiple power conductors in a shielded power cord and electrical components in a metal cabinet having a panel with a receptacle therein for receiving the electrical connector, the method comprising:

providing a connector core having power contacts connected to power conductors in the power cord said contacts for electrical connection with contacts in the receptacle in the metal cabinet when the connector is seated in the receptacle;

placing a conductive foam member around the front edge of said connector core for contact with the face of the panel member when the electrical connector is seated in the receptacle; and placing a metal shield around the connector core and over said conductive foam member for making electrical contact between the conductive foam member and the metal shield for forming an electrical shield around said connector core, said metal shield further being in electrical contact with the shield of said power cable.

11. The method of claim 10 wherein said connector core is plastic having finger members and further comprises making electrical connection with contacts in the finger members of said electrical connection with conductors in said power cord.

12. The method of claim 10 comprising adhesively attaching said conductive foam member to said connector core before said metal shield is placed around said connector core.

13. The method of claim 10 further comprising welding said power cord shield to said metal shield for making electrical connection with the power cord shield and said metal shield.

14. The method of claim 10 comprising top and bottom members over said conductive foam member around said connector core to form said metal shield, and clamping said top and bottom members together with a pair of clamp members.

15. The method of claim 14 further comprising folding metal tabs on said clamp members over at least a portion of said conductive foam member making electrical contact between said metal shield and said conductive foam member.

16. The method of claim 10 wherein said conductive foam member comprises electrical conducting fabric over a core of open-celled polyether polyurethane foam.

17. The method of claim 16 further comprising placing a reduced portion of said conductive foam member between said connector core and said metal members, and extending enlarged portion past the connector core for resilient connection with the panel face when the electrical connector is seated in the receptacle.

18. The method of claim 17 further comprising stiffening said enlarged portion of said conductive foam member with a lip on the outside of said enlarged portion.

* * * * *